US007054569B2

(12) United States Patent
Shin et al.

(10) Patent No.: US 7,054,569 B2
(45) Date of Patent: May 30, 2006

(54) WET ELECTROPHOTOGRAPHIC IMAGE FORMING MACHINE AND METHOD FOR RECOGNIZING A USE LIFE OF A DEVELOPMENT CARTRIDGE USED THEREIN

(75) Inventors: Joong-gwang Shin, Suwon (KR); Geun-yong Park, Suwon (KR); Eun-ah Song, Seoul (KR); Jong-woo Kim, Yongin (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/770,484

(22) Filed: Feb. 4, 2004

(65) Prior Publication Data

US 2004/0184829 A1 Sep. 23, 2004

(30) Foreign Application Priority Data

Mar. 21, 2003 (KR) ..... 10-2003-0017678

(51) Int. Cl.
*G03G 15/10* (2006.01)

(52) U.S. Cl. ..... 399/57; 399/30; 399/58; 399/237

(58) Field of Classification Search ..... 399/30, 399/57, 58, 61, 237, 239, 240
See application file for complete search history.

(56) References Cited

U.S. PATENT DOCUMENTS 6,687,477 B1 * 2/2004 Ichida et al. ..... 399/237
6,744,996 B1 * 6/2004 Brenner ..... 399/57

* cited by examiner

*Primary Examiner*—Hoang Ngo
(74) *Attorney, Agent, or Firm*—Roylance, Abrams, Berdo & Goodman, L.L.P.

(57) ABSTRACT

A wet electrophotographic image forming machine that informs a user of a timing for replacing development cartridges. The image forming machine comprises a control section for sensing the condition of the developer stored in one or more developer housings on the basis of a measured electric current flowing between one or more developer feeding members and one or more developer application members via the developer provided therebetween, and a display section for externally displaying the developer condition according to a signal from the control section. The control section evaluates the magnitude of the electric current and provides a signal to the control section for display if there is a developer amount or concentration deficiency.

20 Claims, 5 Drawing Sheets

WET ELECTROPHOTOGRAPHIC IMAGE FORMING MACHINE AND METHOD FOR RECOGNIZING A USE LIFE OF A DEVELOPMENT CARTRIDGE USED THEREIN

CROSS-REFERENCE TO RELATED APPLICATIONS

This application claims the benefit of Korean Patent Application No. 2003-17678, filed Mar. 21, 2003, in the Korean Intellectual Property Office, the disclosure of which is incorporated herein by reference.

BACKGROUND OF THE INVENTION

1. Field of the Invention

The present invention relates to a wet electrophotographic image forming machine and method of use in which developer is supplied in a cartridge type mechanism, and in particular, to a wet electrophotographic image forming machine which is capable of sensing and externally displaying a developer condition allowing the implementation of a method for recognizing a use life of a development cartridge provided therein and informing a user of a replacement need for the development cartridge.

2. Description of the Related Art

In general, a wet electrophotographic image forming machine using a liquid developing agent (hereinafter, referred to as "developer") forms an image through given electrophotographic image development and transfer processes while continuously maintaining a constant concentration of developer, wherein the concentration is defined as a relative weight ratio between carrier and toner particles indicated by percentage solid.

A description of a developer supplying unit for supplying developer to a photoconductor can be shown by way of an example. A developer supplying unit comprises an enriched developer cartridge containing a developer enriched to have a concentration of 20 to 28% solid, a carrier cartridge containing a solvent for diluting the enriched developer, a developer receptacle for containing developer diluted to a developable concentration (typically achieved by mixing the enriched developer and the carrier, i.e., the solvent), and a concentration sensor and a level sensor for sensing the concentration and remaining amount of the developer contained in the developer receptacle, respectively. In addition, the enriched developer cartridge and the carrier cartridge are also provided with level sensors for sensing remaining amounts of the enriched developer and the carrier, respectively. A waste developer cartridge is also provided for accumulating waste developer which can no longer be used.

A description is provided below of the operation of the aforementioned developer supplying unit for maintaining a constant concentration of developer.

In a first step, enriched developer and carrier are supplied into the developer receptacle from the enriched developer cartridge and the carrier cartridge in a predetermined mixture ratio to form developer with a desired concentration that is most suitable for developing an image (typically about 3% solid). In a second step, the developer is supplied to a photoconductor and then an image is developed in a third, or printing step.

If the concentration of the developer drops below an appropriate value due to continuous or repeated printing operations, the concentration sensor provided for sensing the concentration of the developer in the developer receptacle senses the low concentration and directs the enriched developer of the developer receptacle to be replenished from the enriched developer cartridge, whereby the developer in the developer receptacle can be maintained at a predetermined concentration. If the developer is maintained at an appropriate concentration level while the amount of the developer remaining in the developer receptacle is deficient, the level sensor provided for the developer senses the deficiency of remaining amount of the developer and directs a desired amount of the enriched developer and carrier to be replenished from the enriched developer cartridge and the carrier cartridge, whereby an appropriate amount of the developer can be maintained. In addition, the level sensors provided in the enriched developer and carrier cartridges sense the remaining amount of the enriched developer in the developer cartridge and the remaining amount of the carrier in the carrier cartridge respectively, and inform the user of the sensed results. Then, when required, the user replaces the enriched developer cartridge and/or the carrier cartridge, so that the printing can be continuously performed.

As described above, a wet electrophotographic image forming machine that performs printing using developer is capable of informing a user of the deficiency of developer and replacement timing of an enriched developer cartridge by using respective level sensors. However, with the prior wet electrophotographic image forming machine, it is necessary to also provide a concentration sensor or the like for sensing a concentration of developer because a constant concentration of developer is also desired, as well as providing a separate enriched developer cartridge and carrier cartridge for controlling the concentration of the developer. Accordingly, there is a problem in that the image forming machine is larger and the manufacturing cost thereof increases.

Accordingly, there has been a need for developing a wet electrophotographic image forming machine which is capable of sensing the condition of developer without using a level sensor or a concentration sensor and to externally display the deficiency of developer when the remaining amount or concentration of the developer is deficient.

SUMMARY OF THE INVENTION

Accordingly, an object of the present invention is to solve the above-mentioned problems occurring in the prior art by providing a system and method for a wet electrophotographic image forming machine which is capable of sensing replacement timing required for a development cartridge and informing a user of the replacement timing.

Another object of the present invention is to provide a system and method for a wet electrophotographic image forming machine which is capable of sensing the condition of developer without using a level sensor or a concentration sensor.

Another object of the present invention is to provide a system and method of recognizing a use life of a development cartridge in a wet electrophotographic image forming machine.

These and other objects are substantially achieved by providing a system and method for a wet electrophotographic image forming machine comprising one or more developer housings for storing developer, one or more photoconductors each forming an electrostatic latent image, one or more developer feeding members each located in a position relative to each of the photoconductors to feed the developer to the photoconductors while rotating, and thereby developing an electrostatic latent image, and one or more developer application members each applying the developer stored in the developer housings on the developer feeding members.

The wet electrophotographic image forming machine further comprises a control section for sensing the condition of the developer stored in the developer housings on the basis of electric current flowing between the developer feeding members and the developer application members, and a display section for externally displaying the condition of the developer according to a signal from the control section.

In the preferred embodiment, the wet electrophotographic image forming machine is arranged in such a manner that no electric current flows between the developer feeding members and the developer application members when the developer is not supplied to the developer application members.

In addition, based upon the condition of the developer, the control section of the wet electrophotographic image forming machine judges if the remaining amount of developer is deficient, if the concentration of the developer is deficient, or if the developer is normal, each on the basis of the magnitude of the measured electric current.

The control section then displays the condition of the developer through the display if it is judged that the remaining amount of the developer is deficient or the concentration of the developer is deficient.

Also, in the preferred embodiment of the wet electrophotographic image forming machine, each of the developer feeding members employs a development roller and each of the developer application members employs a deposit roller.

The preferred embodiment of the present invention also provides a method for recognizing a use life of a development cartridge in a wet electrophotographic image forming machine comprising one or more photoconductors and one or more development cartridges, in which each of the development cartridges includes a developer housing for storing developer, a developer feeding member for feeding the developer to a photoconductor, and a developer application member for applying the developer on the developer feeding member. The method comprises the steps of initializing the image forming machine when a power source is turned on, moving the developer stored in the developer housing to the developer application member, measuring electric current flowing between the developer application member and the developer feeding member, and judging the condition of the developer on the basis of the current measurement, wherein the measuring and judging steps are performed by a control section. If the remaining amount or concentration of the developer is judged as being deficient in the judging step, the method performs the step of externally displaying the deficient condition. If the remaining amount or concentration of the developer is judged as being normal in the judging step, the method performs the steps of standing by a printing command, performing printing according to a printing command and then returning to the condition judging step for judging the condition of the developer.

BRIEF DESCRIPTION OF THE DRAWINGS

The above and other aspects, features and advantages of the present invention will be more apparent from the following detailed description taken with reference to the accompanying drawings, in which.

DETAILED DESCRIPTION OF THE PREFERRED EMBODIMENTS

Hereinbelow, an embodiment of the present invention is described in detail with reference to the accompanying drawings, and provides a wet electrophotographic image forming machine and a method for recognizing the use life of a development cartridge used therein.

Figure 1:
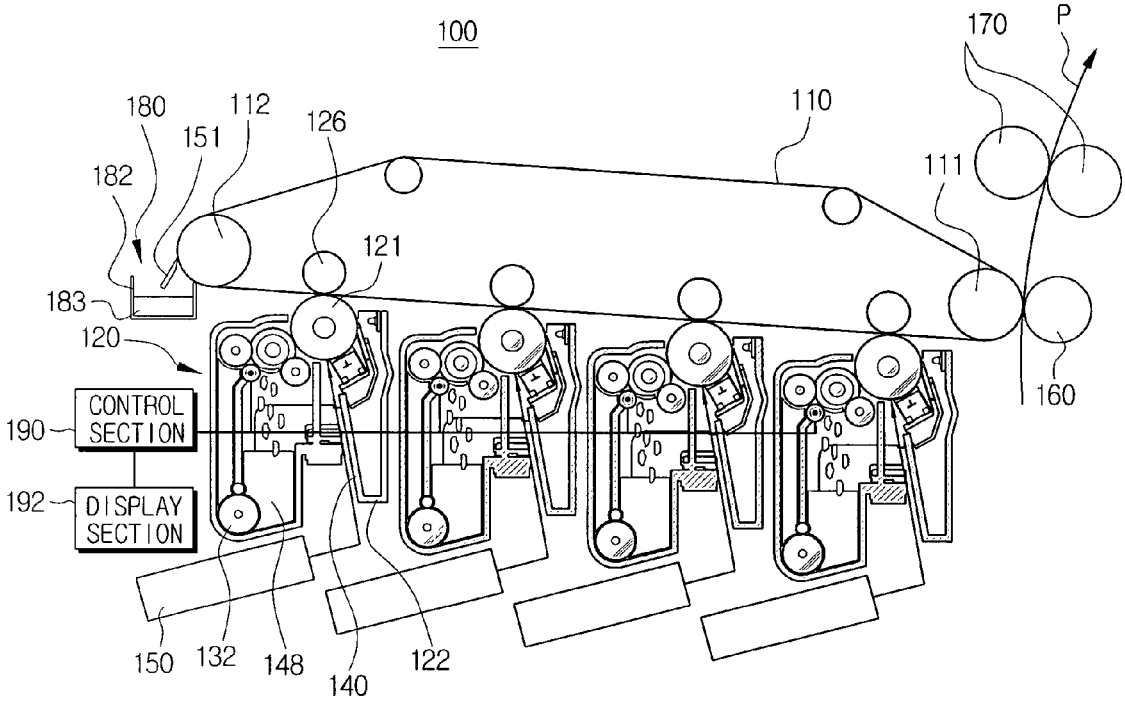
FIG. 1 shows a view in partial cross section of an example wet electrophotographic image forming machine according to an embodiment of the present invention.

FIG. 1 shows a wet electrophotographic image forming machine according to an embodiment of the present invention.

Referring to FIG. 1, the wet electrophotographic image forming machine 100 comprises a transfer belt 110 circulating along an endless route, a plurality of image forming devices 120 for forming an image on the transfer belt 110, a transfer-to-paper inducing roller 160 for transferring the image formed on the transfer belt 110 onto a recording paper P, a pair of fixation rollers 170 for fixing the image on the recording paper P, a transfer belt cleaning apparatus 180 for removing the image remaining on the transfer belt 110, and a control section 190 for controlling the above constituent elements to perform printing.

The transfer belt 110 moves the image, which is repeatedly transferred thereon while the transfer belt 110 is passing through the image forming devices 120, onto the transfer-to-paper inducing roller 160. The transfer belt 110 is driven by a driving roller 111 and a driven roller 112.

Four substantially identical image forming devices 120 are provided containing for example, black, yellow, cyan and magenta colors, respectively, so that color printing can be performed. Each of the image forming devices 120 comprises a photoconductor 121, a corona electrostatic charger 153, a laser scanning unit 150, a development cartridge 130, a transfer-to-belt inducing roller 126, and a photoconductor cleaner 140 as shown in FIG. 2.

The photoconductor 121, comprised of an organic photoconductive (OPC) drum or the like, transfers an image formed on it's surface onto the transfer belt 110. The laser scanning unit 150 is provided between the development cartridge 130 and the photoconductor cleaner 140 along the underside of the photoconductor 121. The photoconductor 121 is provided with an electrostatic latent image, corresponding to an image which will be printed on it's surface, and electrostatically charged by the corona electrostatic charger 153 according to an image signal. The development cartridge 130 is provided along one side of the photoconductor 121, such as along the left side as shown in FIG. 2, and applies the developer 123 onto the surface of the photoconductor 121 based upon an electrostatic latent image, thereby forming a visible image.

Figure 2:
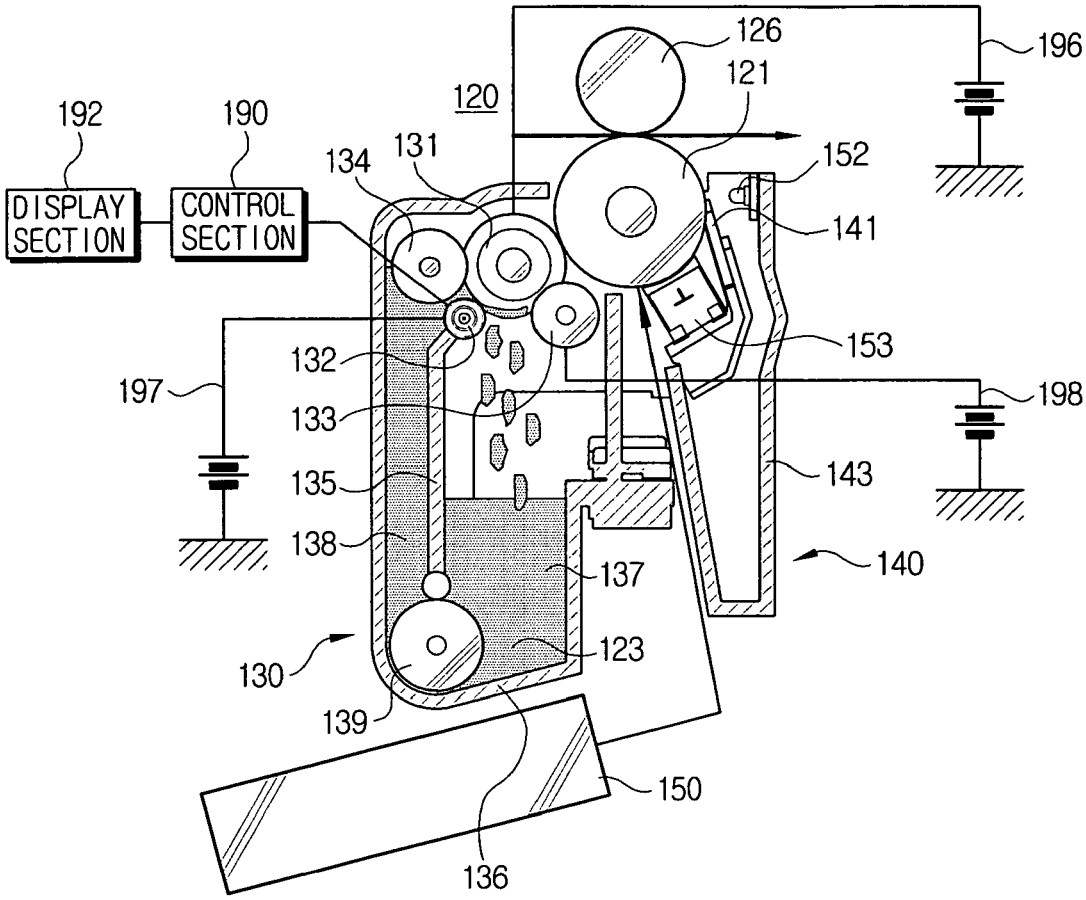
FIG. 2 shows a view in partial cross section of an example development unit comprising a photoconductor and a development cartridge shown in FIG. 1.

The photoconductor cleaner 140 is provided on the other side of the photoconductor 121, such as along the right side as shown in FIG. 2, and removes the residue of developer remaining on the surface of the photoconductor 121 after the image formed on the photoconductor 121 is transferred to the transfer belt 110. The transfer-to-belt inducing roller 126 is located along the upper side of the photoconductor 121 with the transfer belt 110 being sandwiched between the transfer-to-belt inducing roller 126 and the photoconductor 121. The transfer-to-belt inducing roller 126 supports the transfer belt 110 in such a manner that the image formed on the surface of the photoconductor 121 is transferred onto the passing transfer belt 110.

The development cartridge 130 comprises a development roller 131, a deposit roller 132, a metering roller 133, a cleaning roller 134, and a developer housing 136.

The development roller 131 of the development cartridge is positioned adjacent to and faces the photoconductor 121 and serves as a developer feeding member for feeding the developer 123 onto the photoconductor 121 while the development roller 131 is rotating, so that an electrostatic latent image is developed into a visible image. A predetermined magnitude of electric current is applied to the development roller 131 via the circuit 196 so as to feed, or dispose, the developer 123 onto the photoconductor 121.

The deposit roller 132 of the development cartridge 130 is located below the development roller 131 and spaced from the surface of the development roller 131, in which the deposit roller 132 serves as a developer application member for applying the developer 123 stored in the developer housing 136 onto the development roller 131 in required amounts. A predetermined voltage level is applied to the deposit roller 132 so that the developer is electrostatically charged and transferred to the development roller 131. As the developer 123 moves from the deposit roller 132 to the development roller 131, a closed circuit is formed between the deposit roller 132 and the development roller 131, whereby electric current flows in the circuit 197 for applying the voltage to the deposit roller 132. The magnitude of the electric current varies depending on the amount of the developer 123 moving from the deposit roller 132 to the development roller 131.

Figure 4:
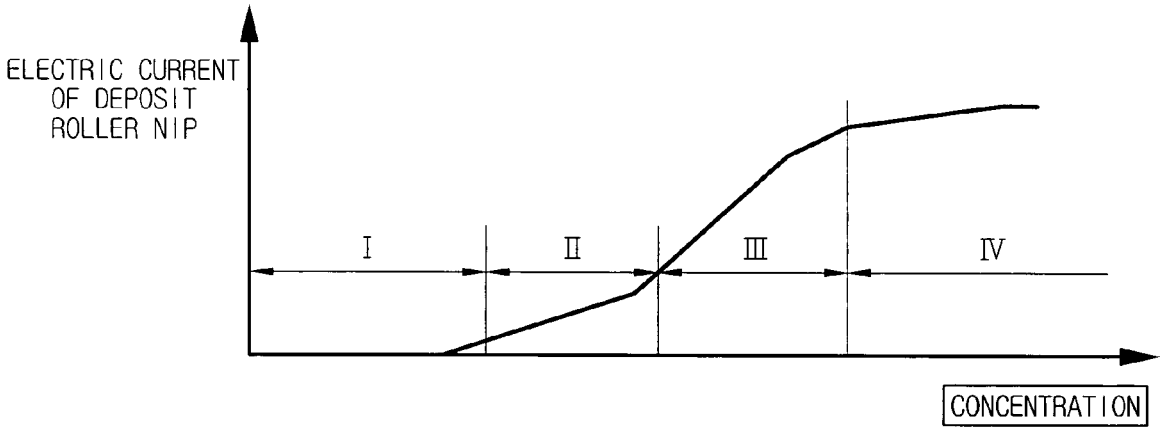
FIG. 4 is a graph showing an example variation of electric current flowing between a developer application member and a developer feeding member shown in FIG. 2, in which the electric current is changed as the developer is applied to the developer feeding member from the developer application member.

FIG. 4 illustrates an example of the variation of the electric current flowing between the deposit roller 132 and the development roller 131, that is, through the nip between the deposit and development roller. Referring to FIG. 4, when the developer 123 does not move, no electric current flows in the nip between the development roller 131 and the deposit roller 132 (see section I of FIG. 4). The situation in which developer 123 does not move is generated when a developer supplying member 139 does not operate, or the developer 123 is not supplied to the deposit roller 132 due to the deficiency of the developer 123.

If the concentration of the developer is deficient even though the developer 123 is supplied to the deposit roller 123 and thereby moving to the development roller 131, a smaller amount of electric current flows in the nip between the development roller 131 and the deposit roller 132 as compared to the case in which the concentration of the developer is normal (see section II of FIG. 4). In addition, if the developer 123 having a normal concentration range is fed from the deposit roller 132 to the development roller 131, an electric current approximately proportional to the concentration of the developer 123 will flow in the nip between the development roller 131 and the deposit roller 132 (see section III of FIG. 4). Furthermore, in an abnormal situation in which the developer 123 having a concentration range equal to or exceeding an appropriate concentration is fed from the deposit roller 132 to the development roller 131, the current in the nip between the development roller 131 and the deposit roller 132 arrives at a peak value for a predetermined concentration of the developer 123 and remains at a substantially constant value regardless of a further increase of the concentration (see section IV of FIG. 4).

Returning to FIG. 2, the metering roller 133 serves as a restriction roller for restricting the developer 123 on the development roller 131 in such a manner that only a fixed amount of the developer 123 is fed to the nip between the photoconductor 121 and the development roller 131, even if the developer 123 is excessively applied on the development roller 131 by the deposit roller 132. In order to provide such a restricting function, a predetermined voltage level is also applied to the metering roller 133 via the circuit 198.

The cleaning roller 134 is provided to remove the developer 123 remaining on the development roller 131 after an electrostatic latent image of the photoconductor 121 is developed.

The upper part of the developer housing 136 receives the various rollers 131, 132, 133, 134 as described above, and the lower part is longitudinally extended and divided into two portions, including a developer supplying passage 138 and a developer reservoir 137, by a partition 135 and a developer supplying member 139. The developer housing 136 stores the developer 123, which is a liquid development agent. In general, it is possible to use a liquid development agent, which consists of toner and liquid carrier as the developer, and which has a high density in the range of about 30 to 40% solid.

In order to reduce the longitudinal length of the housing 136, the development roller 131 is located above the developer reservoir 137 along the left side of the photoconductor 121. The deposit roller 132 is located below the left of the development roller 131, in contact with the top end of the partition 135, and spaced from the development roller 131 by a predetermined distance. In addition, the metering roller 133 is located above the developer reservoir 137 and below the right side of the development roller 131. The cleaning roller 134 is placed above the deposit roller 132 and along the left side of the development roller 131.

Therefore, the upper part of the developer supplying passage 138 is in communication with the inlet side of the nip between the development roller 131 and the deposit roller 132 in such a manner that allows the developer 123 to be supplied to the nip. In addition, because the upper part of the developer reservoir 137 is in communication with the outlet side of the nip between the development roller 131 and the deposit roller 132, and the inlet of the nip between the development roller 131 and the metering roller 133, the developer 123 drifted away from the surface of the development roller 131 by the metering roller 133 freely drops into the developer reservoir 137, thereby being recharged.

The lower part of the partition 135 positioned for partitioning the developer supplying passage 138 and the developer reservoir 137 is further provided with a development supplying member 139 for supplying the developer 123 from the developer reservoir 137 to the developer supplying passage 138. In the embodiment of the present invention shown in FIG. 2, a porous roller is used as the developer supplying member 139, and is formed of a porous material such as sponge so that the developer 123 can be absorbed and moved by the developer supplying member 139. Alternatively, the developer supplying member 139 may consist of an impeller (not shown) or a pump (not shown).

The developer supplying passage 138 is formed in an elongated conduit line shape so that the developer 123 can be easily supplied to the deposit roller 132. Furthermore, the bottom of the developer reservoir 137 is tilted, or slanted toward the developer supplying member 139 so that the developer 123 converges into the developer supplying roller 139, thereby preventing the developer 123 from becoming stagnant and precipitated, or allowing bubbles to form in the developer supplying passage 138 until almost all of the developer 123 is consumed.

The photoconductor cleaner 140 is formed separately from the development cartridge 130 in order to allow easy recovery of waste developer. The photoconductor cleaner 140 comprises a photoconductor cleaning blade 141 for removing waste developer remaining on the photoconductor 121 after an image is transferred from the photoconductor 121 to the transfer belt 110, and a waste developer receptacle 143 for storing the waste developer cleaned from the photoconductor cleaning blade 141.

A corona electrostatic charger 153 is installed on the lower side of the photoconductor cleaning blade 141 for electrostatically charging the surface of the photoconductor 121, and an electrostatic discharger 152, such as electrostatic discharge lamp, is installed on the upper side of the blade 141 for electrostatic discharging of the surface of the photoconductor 121.

Under the photoconductor 121 and positioned between the developer housing 136 of the developer cartridge 130 and the waste developer receptacle 143 of the photoconductor 140, a laser scanning unit 150 is provided to apply an illuminating laser beam to the photoconductor 121 according to image signals.

Returning to FIG. 1, the transfer belt cleaning apparatus 180 removes the residue of developer remaining on the transfer belt 110 after an image formed on the transfer belt 110 is transferred to the recording paper P. The transfer belt cleaning apparatus 180 comprises a transfer belt cleaning blade 151 and a waste developer receptacle 182 for receiving the removed developer residue 183.

The control section 190 controls the aforementioned image forming machine 100 for printing an image on the recording paper P in a manner substantially similar to that of conventional control sections. However, the control section 190 is established in such a manner that the it senses the electric current flowing in a nip between a deposit roller 132 and a development roller 131. As a result, the control section 190 judges the condition of the developer 123 stored in a development cartridge 130 to determine if the developer is normal, if the remaining amount of developer is deficient, and/or if the concentration of developer is deficient. The control section 190 is further connected with a display section 192 for receiving a signal from the control section 190 and displaying the condition of the developer 123. Therefore, if the control section 190 judges the condition of the developer 123 as being deficient in remaining amount or in concentration, the control section 190 outputs a developer condition signal to the display section 192 to display the condition of the developer 123.

Hereinbelow, a description will be made for the operation of the wet electrophotographic image forming machine 100 in accordance with an embodiment of the present invention with reference to FIGS. 1 to 3C.

First, when a printing command is issued, a plurality of developer supplying members 139, which are porous rollers, begin or continue to rotate, whereby developer 123 contained in the developer reservoirs 137 of the development cartridges 130 is absorbed and moved to the developer supplying passages 138.

Next, when the developer supplying members 139 come into contact with a round portion at the bottom of corresponding partitions 135 and thereby become compressed, the developer 123 absorbed into the developer supplying members 139 will be ejected into corresponding developer supplying passages 138. As the developer supplying members 139 continuously supply the developer 123, the developer 123 in the developer supplying passages 138 will rise up to corresponding deposit rollers 132.

Figure 3A:
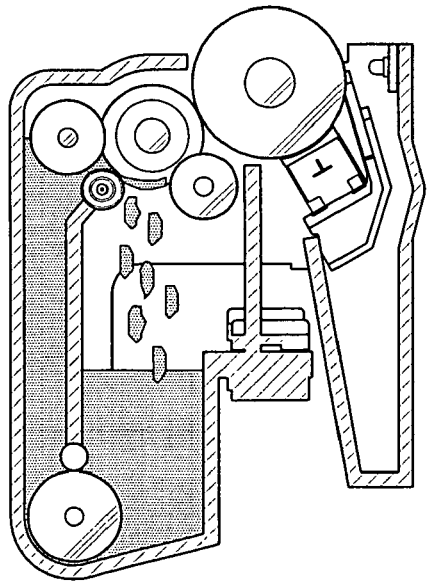
FIG. 3A shows a view in partial cross section of the development unit when the developer condition is normal.

The developer 123 rising up to the corresponding deposit rollers 132 is then fed to corresponding development rollers 131 by the electromotive force of the deposit rollers 132, and forms an electrostatically charged developer film on the development rollers 131. At this time, if the amount of developer 123 contained in corresponding developer reservoirs 137 is normal, the developer 123 is fed to the corresponding development rollers 131 from the deposit rollers 132 as shown in FIG. 3A, and an electric current will flow in the spaces formed between the deposit rollers 132 and the development rollers 131, that is, the nip between the deposit rollers and the development rollers. The electric current flowing in this condition is indicated in section III of FIG. 4.

The developer film formed on the development rollers 131 by the deposit rollers 132 is controlled to have a concentration, thickness and electrostatic charge suitable for developing a latent image upon corresponding photoconductors 121 while a predetermined voltage level is being applied by corresponding metering rollers 133.

At this time, the developer 123 flowing down from the metering rollers 133 while being drifted away from the surface of the development rollers 131 by the metering rollers 133 freely drops into the developer reservoirs 137, thereby being recovered.

The developer 123 dropping into corresponding developer reservoirs 137 will be mixed with the developer remaining in the developer reservoirs 137 and then will be supplied again to the developer supplying passageways 138 by the developer supplying members 139, thereby repeating the above mentioned process.

While a developer film is being formed on the development rollers 131 by the deposit rollers 132 and the metering rollers 133 as described above, a latent image corresponding to an image to be printed is formed on the surface of the photoconductors 121 by corona electrostatic chargers 153 and laser scanning units 150.

Thereafter, when the development rollers 131, having a developer film formed thereon, are engaged with the corresponding photoconductor conductors 121, having a latent image formed thereon and rotating, the developer film formed on the development rollers 131 is fed to the photoconductors 121 due to the difference of voltages applied to the photoconductors 121 and the development rollers 131, that is, an electrostatic force, which develops the latent image into a visible image.

The visible image formed on each photoconductor 121 is then transferred onto the transfer belt 110 from the photoconductor 121 by the voltage and pressure of a transfer-to-belt inducing roller 126 positioned inside the path of the transfer belt 110.

At this point, the photoconductor 121, which has transferred the visible image onto the transfer belt, is electrostatically discharged by an electrostatic discharge lamp 152. Thereafter, the waste developer remaining on the surface of the photoconductor 121 is cleaned by a conductor cleaning blade 141 and then the photoconductor 121 is again electrostatically charged by the corona electrostatic charger 153, thereby being ready for forming a next image.

Thereafter, the first image transferred onto the transfer belt 110 is formed onto the recording paper P as a desired image through a sequential image forming processes, such as secondary transfer and fixing, as shown in FIG. 1. Following this, the developer residue 183 remaining on the transfer belt 110 after the image is transferred onto the recording paper P is removed by a transfer belt cleaning blade 151 and recovered in the waste developer receptacle 182.

Figure 3B:
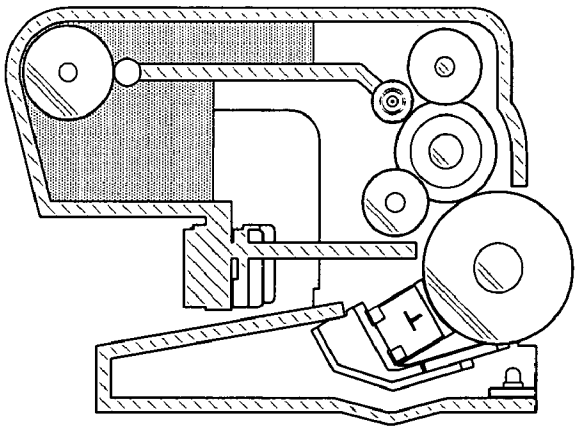
FIG. 3B shows a view in partial cross section of the development unit when the remaining amount of developer is deficient.

In the case where the developer 123 stored in the development cartridge 130 is normal, a desired image is printed on the recording paper P through various processes as described above. However, when the remaining amount of the developer 123 of a development cartridge 130 is deficient, the developer 123 cannot be supplied to a corresponding deposit roller 132 as shown in FIG. 3B. Therefore, no electric current will flow in the nip between the deposit roller 132 and the development roller 131. The control section 190 will sense the lack of current and output a signal indicating a developer remaining amount deficiency to the display section 192.

Figure 3C:
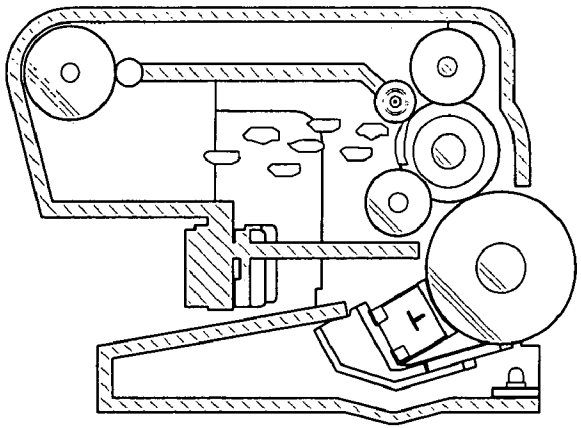
FIG. 3C shows a view in partial cross section of the development unit when the concentration of developer is normal.

If the remaining amount of developer 123 is sufficient but it's concentration is deficient as shown in FIG. 3C, the electric current flowing in the nip between the deposit roller 132 and the development roller 131 is reduced as shown in section II of FIG. 2, as compared with the normal developer 123 condition. In this case, the control section 190 detects the condition and outputs a signal indicating the developer concentration deficiency to the display section 192. The user can then visually view the output content of the display section 192 and replace the development cartridge 130, with the result that normal printing can be continuously performed.

Figure 5:
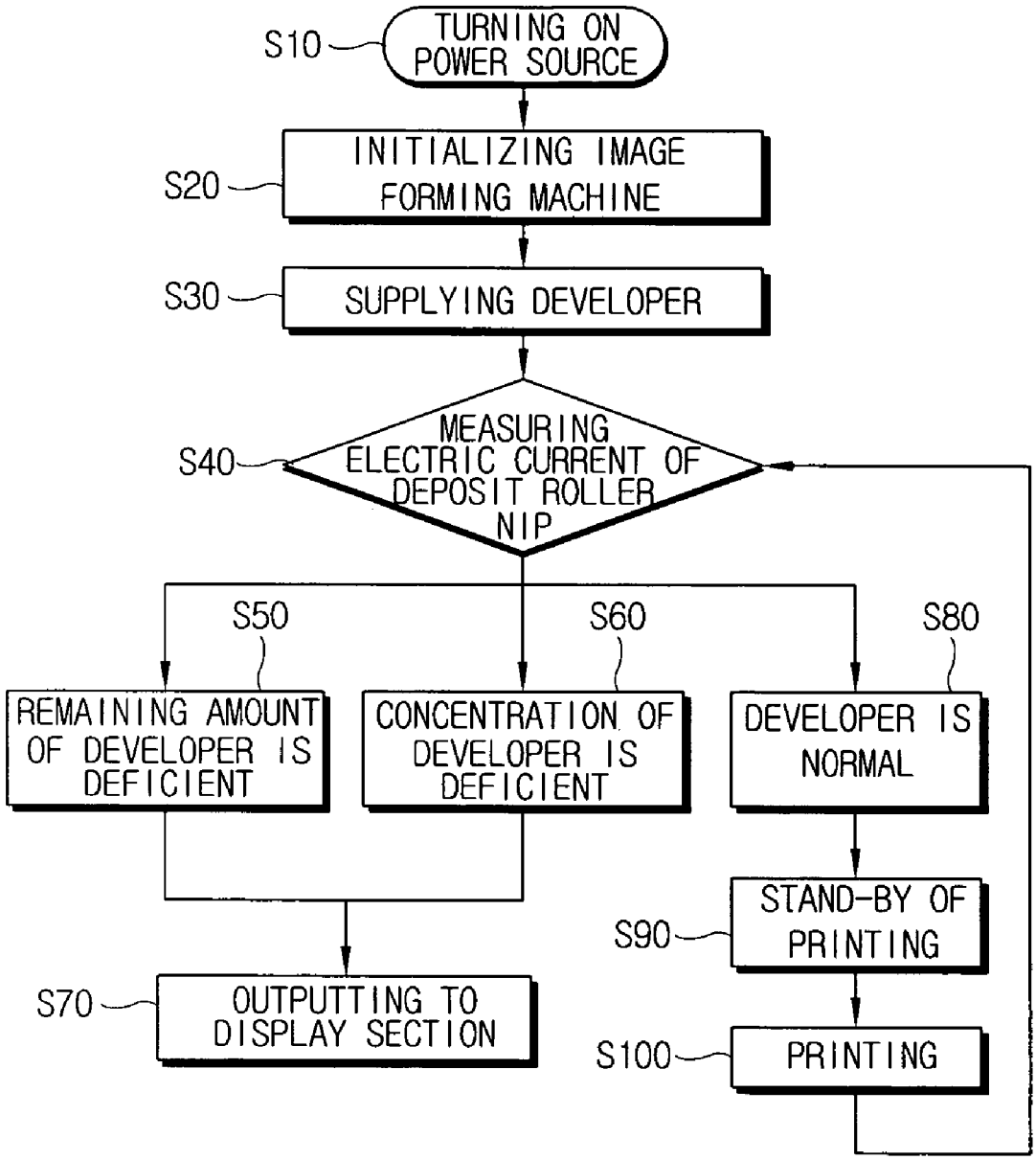
FIG. 5 is a flowchart illustrating a method for recognizing a use life of an example development cartridge in the wet electrophotographic image forming machine shown in FIG. 1.

Hereinbelow, a description will be made for a method for recognizing a use life of a development cartridge 130 in a wet electrophotographic image forming machine 100 in accordance with an embodiment of the present invention with reference to the flow chart of FIG. 5.

When the power source of the image forming machine 100 is turned on at step S10, the control section 190 initializes the image forming machine 100 at step S20. Through the initialization of the image forming machine 100, all constituent components return to initial states thereof, so that they can be ready for printing, and a desired part such as a fixing roller is preheated to a given temperature.

Following this, a developer supplying member 139 of a developer cartridge 130 operates and moves developer 123 in a corresponding developer reservoir 137 into a developer supplying passage 138 at step S30. As the developer supplying member 139 continuously operates, the developer 123 rises up to a deposit roller 132.

At the time when the developer 123 is to be supplied to the deposit roller 132, the control section 190 rotates the deposit roller 132 and measures the electric current flowing in the nip between the deposit roller 132 and a corresponding development roller 131 at step S40.

The control section 190 judges the condition of the developer 123 on the basis of the measured electric current in the nip between the deposit roller 132 and the developer roller 131. If no electric current flows in the nip as indicated in section I of FIG. 4, the control section 190 judges that the remaining amount of the developer is deficient at step S50, and outputs a signal indicating the condition of the developer to the display section 192 at step S70.

In addition, if the electric current flowing in the nip is reduced as compared to that in the normal condition as indicated in section II of FIG. 4, the control section judges that the concentration of the developer is deficient at step S60, and outputs a signal indicating the deficiency of concentration of developer to the display section 192 at step S70. Finally, if the electric current flowing in the nip is within the normal range of electric current as shown in sections III and IV of FIG. 4, the control section judges the condition of the developer as being normal at step S80, and enters the stand-by state for printing at step S90, followed by printing at step S100.

When a printing command is received in the stand-by state, printing is performed and the process returns to the steps of measuring the electric current in the nips between the deposit rollers and the developer rollers, and of judging the condition of developer at step S40. Then, the above-mentioned steps are repeated.

As described above, the method for recognizing a use life of a development cartridge according to an embodiment of the present invention allows a user to easily recognize a use life of a developer cartridge on the basis of developer condition information output through a displaying section. This ensures that the user can perform printing without complications by properly replacing a deficient development cartridge containing the developer.

As described above, the user can easily recognize a replacement timing of a development cartridge in use with the wet electrophotographic image forming machine according to an embodiment of the present invention, because the condition of developer in the development cartridge is displayed through a display section.

In addition, with the method for recognizing the use life of a development cartridge according to an embodiment of the present invention, it is possible to inform the user of a replacement timing of a development cartridge.

While the preferred embodiment of the present invention has been shown and described with reference to the preferred embodiments thereof, the present invention is not limited to the embodiments. It will be understood that various modifications and changes can be made by those skilled in the art without departing from the spirit and scope of the invention as defined by the appended claims. It should be considered that such modifications, changes and equivalents thereof are all included within the scope of the present invention and the following claims.

What is claimed is:

1. A wet electrophotographic image forming machine comprising:

at least one developer housing for storing developer;

at least one photoconductor for forming an electrostatic latent image;

at least one developer feeding member each located in a position relative to the at least one photoconductor to feed the developer to the at least one photoconductor while rotating and thereby developing an electrostatic latent image;

at least one developer application member each applying the developer stored in the developer housings on the at least one developer feeding member;

a control section for detecting the condition of the developer stored in the at least one developer housing based on electric current flowing between at least one said developer feeding member and at least one said developer application member without requiring an additional measurement input; and a display section for externally displaying said sensed condition of the developer according to a signal from the control section.

2. The image forming machine according to claim 1, wherein substantially no electric current flows between the at least one developer feeding member and the at least one developer application member when the developer is not supplied therebetween.

3. The image forming machine according to claim 2, wherein the control section detects an insufficient developer amount condition when substantially no electric current is sensed flowing between the at least one developer feeding member and the at least one developer application member, and communicates said detected condition to said display section for display.

4. The image forming machine according to claim 1, wherein a first electric current magnitude flows between the at least one developer feeding member and the at least one developer application member when a sufficient level of developer having an insufficient concentration level is supplied therebetween.

5. The image forming machine according to claim 4, wherein the control section detects an insufficient developer concentration condition when said first electric current magnitude is sensed flowing between the at least one developer feeding member and the at least one developer application member, and communicates said detected condition to said display section for display.

6. The image forming machine according to claim 1, wherein a second electric current magnitude flows between the at least one developer feeding member and the at least one developer application member when a sufficient level of developer having a sufficient concentration is supplied therebetween.

7. The image forming machine according to claim 6, wherein the control section detects a sufficient level of developer having a sufficient concentration condition when said second electric current magnitude is sensed flowing between the at least one developer feeding member and the at least one developer application member.

8. The image forming machine according to claim 1, wherein the control section detects the condition of the developer based upon a magnitude of the electric current sensed flowing between the at least one developer feeding member and the at least one developer application member and in response, determines if the amount of developer is deficient, if the concentration of developer is deficient, or if the developer is normal.

9. The image forming machine according to claim 8, wherein the control section displays the detected condition of the developer through the display if it is judged that the remaining developer amount or the developer concentration is deficient.

10. The image forming machine according to claim 1, wherein each of the developer feeding members comprises a development roller and each of the developer application members comprises a deposit roller.

11. A method for recognizing a use life of a development cartridge in a wet electrophotographic image forming machine comprising at least one photoconductor, at least one development cartridge, each including a developer housing for storing developer, a developer feeding member for feeding the developer to a photoconductor, and a developer application member for applying the developer on the developer feeding member, the method comprising steps of:

initializing the image forming machine when a power source is turned on;

moving the developer stored in the developer housing to the developer application member;

measuring electric current flowing between the developer application member and the developer feeding member;

judging the condition of the developer based on the measured electric current without requiring an additional measurement input;

externally displaying the condition if the developer condition is judged as being amount deficient or concentration deficient in the judging step;

standing by a printing command if the developer condition is judged as being normal in the judging step; and performing printing according to a printing command and then returning to the condition judging step for judging the condition of the developer.

12. The method for recognizing a use life of a development cartridge according to claim 11, wherein:

substantially no electric current flows between the developer feeding member and the developer application member when the developer is not supplied therebetween;

a first electric current magnitude flows between the developer feeding member and the developer application member when a sufficient level of developer having an insufficient concentration level is supplied therebetween; and a second electric current magnitude flows between the developer feeding member and the developer application member when a sufficient level of developer having a sufficient concentration is supplied therebetween.

13. The method for recognizing a use life of a development cartridge according to claim 12, wherein:

the condition of the developer is judged as amount deficient if substantially no electric current is measured flowing between the developer application member and the developer feeding member;

the condition of the developer is judged as concentration deficient if said first electric current magnitude is measured flowing between the developer application member and the developer feeding member; and the condition of the developer is judged as normal if said second electric current magnitude is measured flowing between the developer application member and the developer feeding member.

14. A developer condition monitoring system for use with an image forming machine, comprising:

a developer feeding member, adapted to transfer a developer to a developer application member;

a developer application member, adapted to receive a developer from said developer feeding member for use in developing an electrostatic latent image;

a controller, adapted to control and measure a conduction of an electric current between said developer feeding member and said developer application member via said transferred developer positioned therebetween, said controller further being adapted to determine a developer condition based upon a magnitude of said electric current without requiring an additional measurement input; and a controller display section, adapted to provide an external display of said developer condition.

15. A developer condition monitoring system for use with an image forming machine as claimed in claim 14, wherein:

substantially no electric current is conducted between said developer feeding member and said developer application member when said developer is not supplied therebetween;

a first electric current magnitude is conducted between said developer feeding member and said developer application member when a sufficient level of said developer having an insufficient concentration level is supplied therebetween; and a second electric current magnitude is conducted between said developer feeding member and said developer application member when a sufficient level of said developer having a sufficient concentration is supplied therebetween.

16. A sensorless developer condition monitoring system for use with an image forming machine as claimed in claim 15, wherein said controller determines:

an insufficient developer amount condition exists where said substantially no electric current is measured, and in response, said controller communicates said developer condition to said display section for display;

an insufficient developer concentration condition exists where said first electric current magnitude is measured, and in response, said controller communicates said developer condition to said display section for display; and a sufficient level of developer having a sufficient concentration condition exists where said second electric current magnitude is measured.

17. A sensing apparatus for use with an image forming machine, the sensing apparatus comprising:

a control section for sensing a condition of a developer stored in at least one developer housing of the image forming machine based upon an applied electric current flowing between at least one developer feeding member and at least one developer application member of the image forming machine as conducted by the developer supplied therebetween without requiring an additional measurement input.

18. A sensing apparatus as claimed in claim 17, further comprising:

a display section adapted to display information representative of the sensed condition of the developer according to a signal indicative of the sensed condition provided by the control section.

19. A sensing apparatus as claimed in claim 17 wherein the applied electric current comprises:

a negligible magnitude when said developer is not supplied therebetween;

a first magnitude when a sufficient level of said developer having an insufficient concentration level is supplied therebetween; and a second magnitude when a sufficient level of said developer having a sufficient concentration is supplied therebetween.

20. A sensing apparatus as claimed in claim 19 wherein the sensed condition is comprised of:

an insufficient developer amount condition where said negligible electric current magnitude is measured;

an insufficient developer concentration condition where said first electric current magnitude is measured; and a sufficient level of developer having a sufficient concentration condition where said second electric current magnitude is measured.

* * * * *